United States Patent [19]

Krystal

[11] Patent Number: 4,486,903

[45] Date of Patent: Dec. 11, 1984

[54] CAP WITH EAR BAND

[76] Inventor: Joseph Krystal, 16 Plymouth Ave., Toronto, Ontario, Canada, M6J 1Z1

[21] Appl. No.: 575,479

[22] Filed: Jan. 30, 1984

Related U.S. Application Data

[63] Continuation of Ser. No. 349,181, Feb. 17, 1982.

[51] Int. Cl.[3] ..... A42B 1/06

[52] U.S. Cl. ..... 2/197

[58] Field of Search ..... 2/100, 171.1, 171.2, 2/171.3, 172, 174, 195, 209.4, 183, 185 C, 197, 198, 423

[56] References Cited

U.S. PATENT DOCUMENTS

| | | | |
|---|---|---|---|
| 2,181,446 | 11/1939 | Ames | 2/171.2 |
| 2,869,134 | 1/1959 | Milstein | 2/195 |
| 2,883,669 | 4/1959 | Rafowitz et al. | 2/172 |
| 2,885,683 | 5/1959 | Lipkin | 2/172 |
| 3,128,474 | 4/1964 | Feldman | 2/195 |
| 3,497,874 | 3/1970 | Molitoris | 2/423 |

*Primary Examiner*—Werner H. Schroeder
*Assistant Examiner*—Mary A. Ellis
*Attorney, Agent, or Firm*—Fetherstonhaugh & Co.

[57] ABSTRACT

The invention is an adjustable cap with a back opening and a strip of adjustable length whereby the cap can be adjusted as to size that has an inband that can be stored in the head cover or folded downwardly to cover the ears. The inband pattern has an upper edge that curves downwardly on each side of a center portion so that when it is sewn into the cap the end portions of the inband are stressed to bias them inwardly to hug the head and ears in use.

1 Claim, 5 Drawing Figures

CAP WITH EAR BAND

This application is a continuation of application Ser. No. 349,181, filed Feb. 17, 1982.

This invention relates to hats and caps that are made with a back opening in the back marginal edge portion and a strip of adjustable length joining the sides of the back opening so that the hat or cap can be made to fit any size head.

Such caps are popular with users and also with manufacturers and retailers. The user can adjust the cap to get a good fit and manufacturers and retailers are spared the problem of storing every size of cap to serve the consumer public.

There is a need for such a cap with an inband that can be stored in the head cover and also folded down to cover the ears, but no one prior to this invention has been able to make such a cap with a suitable inband. These caps are supplied for summer use without inbands, but for winter when an inband is required it is practice to supply a similarly shaped cap without the back opening and in different sizes for different sized heads.

An inband is a band that can be folded into the cap when not required for use but that can also be turned down from its folded position to extend in a downward direction and cover the ears. These bands consist merely of a straight band of fabric foldable about the lower edge of the cap and extending all the way around the edge of the cap. They depend downwardly a much shorter distance at the area of the forehead than they do the ears and back of the head. These bands must be continuous around the back of the head to achieve an ear hugging function and this is the requirement that previously has made them of no use with the adjustable cap. In the case of the adjustable cap they cannot be made continuous at the back portion of the cap and because of the back opening a conventional inband will not work on an adjustable cap.

It is, therefore, an object of this invention to provide a construction for a cap of the kind that has a head cover with a back opening in the back marginal edge portion thereof with a strap of adjustable length across the back opening so that it can be adjusted for different sizes that has an inband that can be folded within the head cover so as to be out of sight and also folded downwardly to cover the ears.

A cap according to the invention comprises a head cover having a back opening in the back marginal edge portion thereof, a strap of adjustable length across the lower end of the back opening whereby the size of the marginal edge of the head cover can be adjusted, an inband for the head cover hinged to the edge of the head cover and extending around the marginal edge of the head cover from one side edge of said back opening to the other side edge of said back opening, said inband having a free pattern shape the upper edge of which curves downwardly on each side of the centre portion whereby when the inband is joined to the marginal edge of the head cover the fabric of the inband adjacent the back opening is stressed to bias it inwardly under conditions of use.

The invention will be clearly understood after reference to the drawings.

Figure 1:
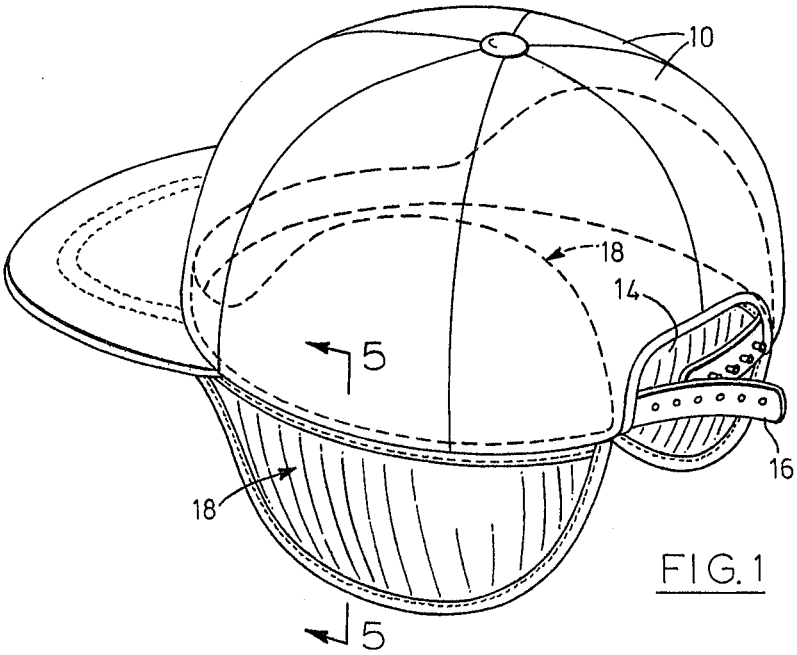
FIG. 1 shows a cap showing the inband folded down in solid lines and folded up in dotted lines.

The cap illustrated in the drawings has a head cover made from six pie shaped sections 10 joined at their meeting edges by stitching to tapes and finished along their inwardly turned marginal edges with a sweat band 12. The head cover has a back opening 14 in the back marginal edge portion thereof and a strap of adjustable length across the lower edge of the back opening so that the size of the marginal edge of the head cover can be adjusted. In the embodiment of the invention illustrated the adjustable strap 16 has free ends. It is made of plastic material. One free end has lugs extending therefrom while the other free end is formed with openings spaced similarly to the lugs so that the two free ends of the strap can be joined at any desired length. This kind of adjustment in a cap is well known. Other kinds of adjustment are also well known. For example, the sections of the strap could be made from a self-adhesive material sold under the trade mark VELCRO. Alternatively, any kind of a fastener could be employed for the ends of the adjustable strap to achieve size adjustment of the cap.

There is nothing novel in the provision of an adjustable cap.

Figure 3:
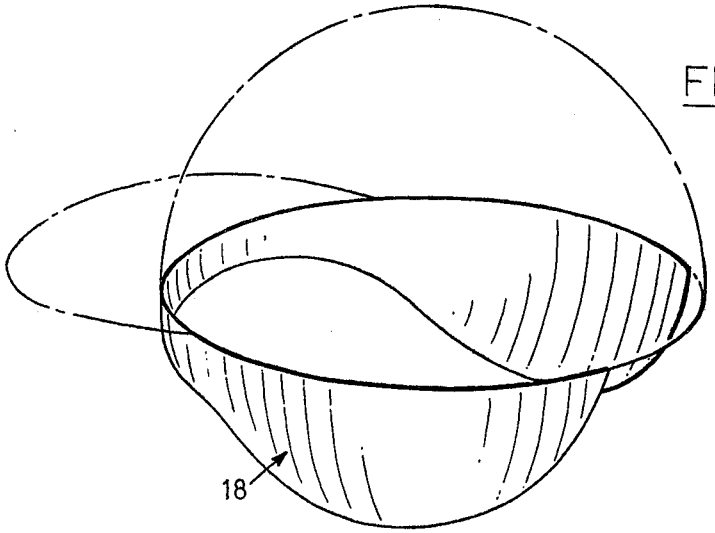
FIG. 3 is a view showing the inband attached to the perimeter of a hat outline.

The cap has an inband generally indicated by the numeral 18 that can be folded from an upward position within the head cover where it is inconspicuous to the dotted line position in FIG. 3 to a downward position where the end portions thereof form ear covers. It will be noted that the free end portions of the inband that cover the ears incline inwardly of the edge of the cap. This inward inclination of the free end portions of the inband causes them to hug the ears and is achieved by a special design of the free pattern shape of the inband.

Figure 4:
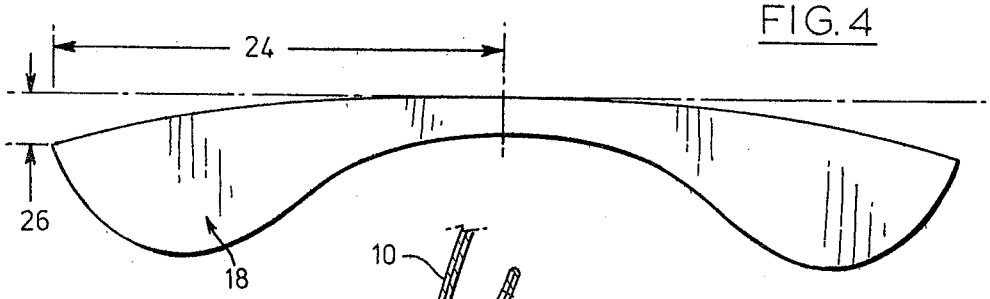
FIG. 4 shows the outline of an inband before it is sewn into the cap.

The inband pattern is illustrated in FIG. 4 and has an upper edge which curves downwardly on each side of the centre portion. The upper edge of a standard inband is straight and would assume a form along line 20. By curving the upper edge of the free pattern shape of the inband downwardly on each side of the centre portion of the inband the fabric of the inband adjacent the back ends thereof that hug the ears is stressed as the inband is sewn into the cap to bias it inwardly. The edge of the head cover is straight and the forming of the head cover to the inband produces the required stressing.

Figure 5:
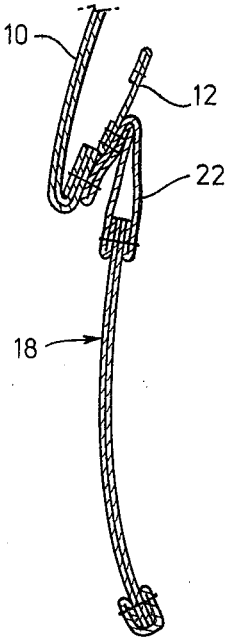
FIG. 5 is a view along line 5—5 of FIG. 1.

As illustrated in FIG. 5, the inband 18 is stitched to the sweat band 12 and to the lower edge of the head cover by a folded bias cut tape 22. Thus, by providing an inband of the general characteristic illustrated one can achieve a cap with a back opening in the head cover that has an inband that can be folded to an inconspicuous position within the head cover and also folded to a downward position that will hug the hears of the wearer in use.

It is not intended that the invention should be restricted to the embodiment illustrated. It can be applied to adjustable caps having a back opening of any general characteristics. The important thing is the provision of an inband for such a cap that will hug the ears.

Figure 2:
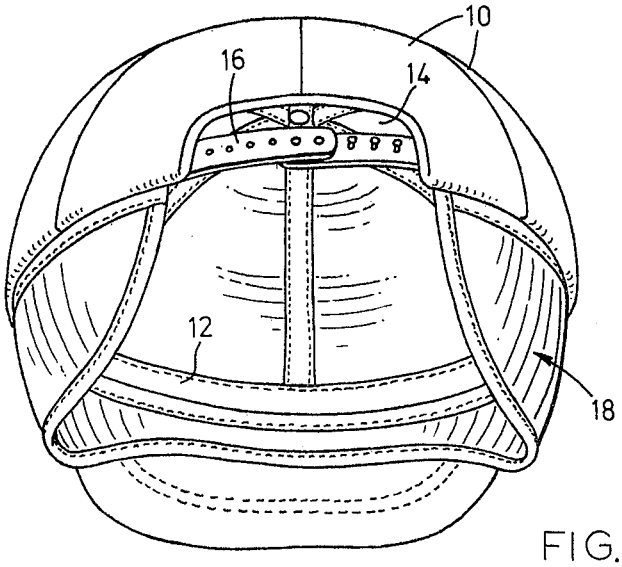
FIG. 2 shows the cap from the rear and below.

The downwardly inclined inband inclines inwardly adjacent the back as shown in FIG. 2 to hug the ears and head of a wearer in use.

The amount of curvature of the free pattern shape of the inband to achieve the ear and head hugging effect at the back of the inband may vary with characteristics of material selected. A cap made from a material consisting of polyester fabric laminated to a thin sheet of foam plastic with a headband dimension 24 of about 9½ inches and a dimension 26 of about ¾ inches is satisfactory. A person skilled in the art would be able to determine the proper dimensions if different for different materials. The downward curvature is sufficient to achieve the ear hugging function.

The embodiments of the invention in which an exclusive property or privilege is claimed are defined as follows:

1. A cap comprising:

a head cover of textile fabric having a lower marginal edge and having a back opening in the back portion of the head cover and in the lower marginal edge thereof;

a peak extending from the front centre portion of the head cover;

an adjustable strap across the lower edge of the back opening whereby the size of the marginal edge of the head cover can adjust to fit the wearer;

an inband of textile fabric for the head cover hinged to the edge of the head cover and extending around the marginal edge of the head cover from one side edge of said back opening around said front centre portion and to the other side edge of said back opening;

said hinged inband being foldable between a folded position above the marginal edge of the head cover juxtaposed to the head cover and a down position where it extends below the marginal edge of the head cover;

said lower marginal edge of the head cover being straight and said inband having a free pattern shape including two side portions and a centre portion, the upper edges of the side portions curving downwardly on each side of the upper edge of the centre portion and said upper edges being sewn to the lower marginal edge of the head cover to form the inband to the marginal edge, whereby when the inband is moved to the down position the fabric of the inband adjacent the back opening is stressed to bias it inwardly against the head of a user under conditions of use.

* * * * *